US006293728B1

(12) United States Patent
Eggleton et al.

(10) Patent No.: US 6,293,728 B1
(45) Date of Patent: Sep. 25, 2001

(54) CURB FORMING APPARATUS AND METHOD

(76) Inventors: Richard C. Eggleton, 8 Blue Lagoon Court, Nerang, Queensland; Samuel Sebastian Eggleton, 9 Anderson Court, Bonogin 4213, Queensland; Bradley Gordon Graham, 29 Eureka Crescent, Nerang 4211, Queensland, all of (AU)

( * ) Notice: Subject to any disclaimer, the term of this patent is extended or adjusted under 35 U.S.C. 154(b) by 0 days.

(21) Appl. No.: 09/315,662

(22) Filed: May 20, 1999

(51) Int. Cl.[7] ..... E01C 11/22; E01F 9/053
(52) U.S. Cl. ..... 404/98; 404/105; 404/100
(58) Field of Search ..... 404/98, 100, 105, 404/6; 425/64

(56) References Cited

U.S. PATENT DOCUMENTS

| | | | | |
|---|---|---|---|---|
| 3,261,272 | * | 7/1966 | Jennings, Jr. | 404/98 |
| 3,421,419 | * | 1/1969 | Adcock | 404/100 |
| 3,792,133 | * | 2/1974 | Goughnour | 404/98 |
| 4,084,928 | * | 4/1978 | Petersilk | 425/64 |
| 4,310,293 | * | 1/1982 | Eggleton | 425/62 |
| 4,312,602 | * | 1/1982 | Dale | 404/100 |
| 4,636,110 | * | 1/1987 | Augoyard | 404/100 |
| 4,742,970 | * | 5/1988 | Barazone | 242/86.52 |
| 5,354,189 | * | 10/1994 | McKinnon | 425/64 |
| 6,123,443 | | 9/2000 | Conway | 362/576 |

* cited by examiner

*Primary Examiner*—Eileen D. Lillis
*Assistant Examiner*—Raymond W. Addie
(74) *Attorney, Agent, or Firm*—Parsons & Goltry; Michael W. Goltry; Robert A. Parsons

(57) ABSTRACT

Curb forming apparatus comprising a device for pushing hardenable material through a channel defined by a mold and a feed extending into the channel for forming a groove into the hardenable material and for supplying elongate stock to the groove.

23 Claims, 4 Drawing Sheets

20
22
91
44
25
45
41
90
40
42
43
60
26
21
61
27
46
30
24
23
26
28

20
44
25

91
45
43
42
40
41
90
30
28
26
60
26
24
46
27
61
21

120
121
124
125
126
122
129
127
123
128

130
131
132
120

120
121
125
124
123
122
126
127

80
78
80
80
24
50
61
55
75
57
79
80
73
60
71
70
64
77
56
51
23
62
27
76
72
74
71

120
121
125
124
123
122
127

61
81
82
60
73
27
72
63
62

28
26
30

CURB FORMING APPARATUS AND METHOD

This application claims the benefit of previously filed Australian Provisional Patent Application Number PP7683 entitled "Improved Concrete Edging Strips" filed Dec. 14, 1998 by Samuel Sebastian Eggleton and Bradley Gordon Graham.

FIELD OF THE INVENTION

This invention concerns curbing and, more particularly, improved curb architectures and curb forming apparatus and methods.

BACKGROUND OF THE INVENTION

A curb is a border that forms an enclosing or dividing framework or part of a gutter along the edge of a street. Although curbing, especially concrete curbing, exhibits important structural and functional characteristics, its aesthetic appeal is now beginning to prove desirable in landscape architecture. With the availability of concrete dies and specially designed curb forming devices, concrete curbing can be extruded in a wide variety of colors and shapes. Beyond aesthetic and design concerns, however, little has been done to enhance the functionality of curbing in landscape environment and of modifying conventional curb forming devices to accommodate specific structural and functional curb improvements. In view of these and other deficiencies in the art, the continued need for new and useful improvements is evident.

Accordingly, it would be highly desirable to provide improved curb architectures and curb forming apparatus and methods.

It is a purpose of the invention to provide new and improved curb forming apparatus that are easy to construct.

It is another purpose of the invention to provide new and improved curb forming apparatus that are easy to use.

It is still another purpose of the invention to provide new and improved curb forming apparatus that are inexpensive.

It is a further provision of the invention to provide new and improved curb forming apparatus for forming a curb or strip having a groove for accommodating a water distribution system.

It is still a further provision of the invention to provide new and improved curb forming apparatus for forming a curb or strip having groove for accommodating illumination apparatus.

It is yet still a further provision of the invention to provide a curb architecture having water distribution apparatus.

It is yet a further provision of the invention to provide a curb architecture having illumination apparatus.

It is another purpose of the invention to provide new and improved curb forming apparatus that is safe and efficient.

It is still another purpose of the invention to provide new and improved curb formation methods.

SUMMARY OF THE INVENTION

The above problems and others are at least partially solved and the above purposes and others realized in new and improved curb architectures and curb forming apparatus and methods. In a particular embodiment, curb forming apparatus of the invention comprises a device for pushing hardenable material through a channel defined by a mold, a source of elongate stock and a feed extending into the channel for forming a groove into the hardenable material and for supplying the groove with the elongate stock. The elongate stock is preferably flexible and removable from the groove. The source of elongate stock may be carried by the device and the mold may support the feed. The feed comprises a receptacle including an upstream end for receiving the elongate stock and a downstream end for directing the elongate stock into the groove. The downstream end of the receptacle normally extends into the channel. The receptacle can be rigidly mounted or adjustable between a first position and a second different position. After extruding a curb and the hardenable material has at least partially hardened or cured, the elongate stock may be removed and replaced with illumination apparatus or water distribution apparatus for forming useful curb architectures.

In another embodiment, curb forming apparatus of the invention may comprise a device for pushing hardenable material through a channel defined by a mold and a protuberance extending into the channel for forming a groove into the hardenable material. The mold may support the protuberance and the protuberance may extend along substantially the entire length of the mold if desired.

Consistent with the foregoing, associated curb formation methods may also be provided.

BRIEF DESCRIPTION OF THE DRAWINGS

The foregoing and further and more specific objects and advantages of the invention will become readily apparent to those skilled in the art from the following detailed description thereof taken in conjunction with the drawings in which.

DETAILED DESCRIPTION OF PREFERRED EMBODIMENTS

The present invention provides, among other things, new and improved curb architectures, curb forming apparatus and methods. Ensuing embodiments of the invention are easy to use and construct, and prove exemplary for enhancing not only the aesthetic, but also the structural and functional characteristics of extruded curbing. In the interest of clarity of the ensuing discussion, §A presents the structural and functional attributes of a new and improved curb forming apparatus, §B presents new and improved curb architectures, §C presents various embodiments of extrusion molds of the invention, §D presents a brief discussion of a hand trowel for forming a groove into hardenable material, and §E presents a brief discussion of new and improved stamp apparatus for introducing an impression into an extruded curb.

§A. Curb Forming Apparatus

Figure 1:
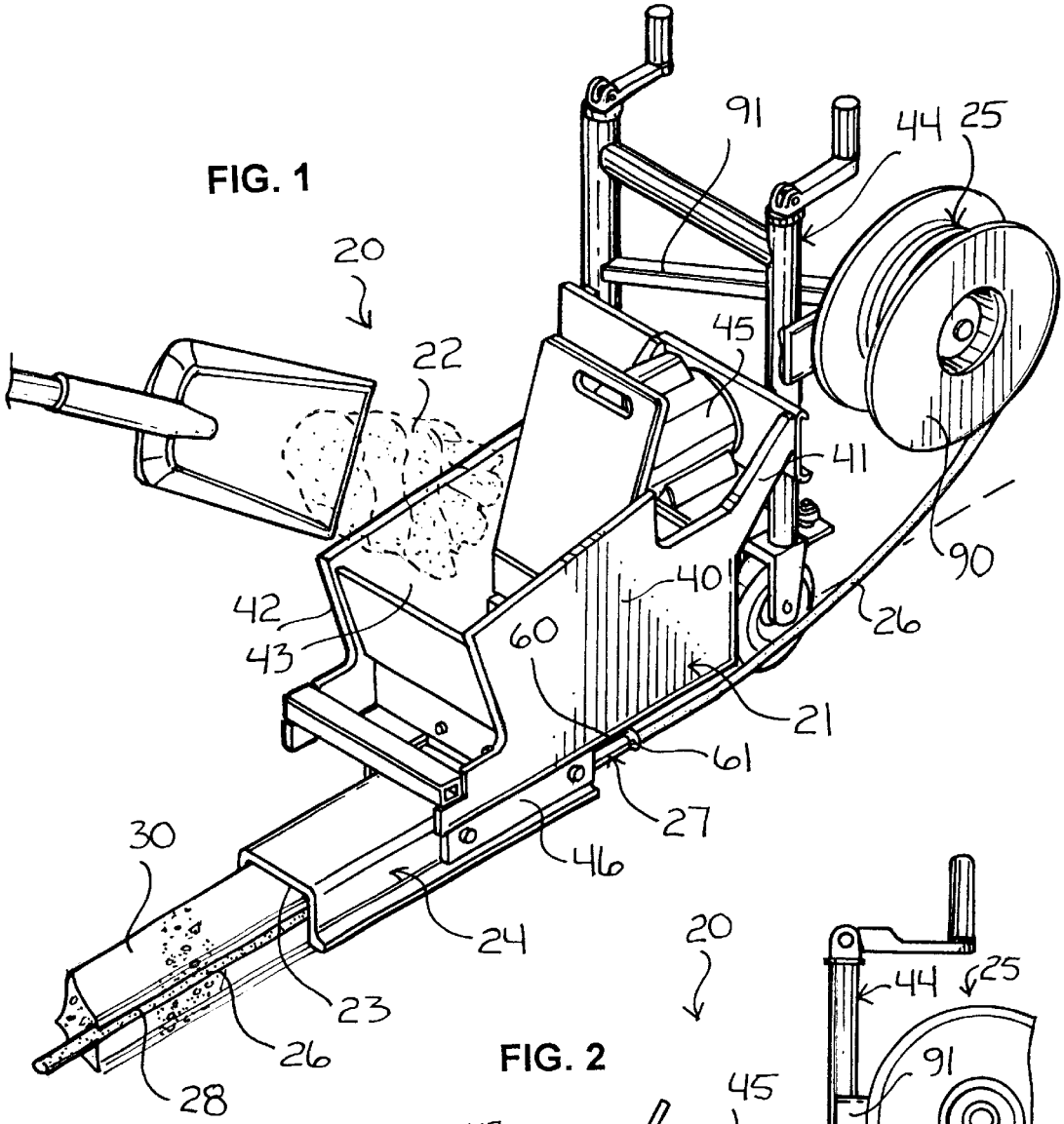
FIG. 1 is an isometric view of curb forming apparatus comprising a device for pushing hardenable material through a channel defined by a mold, a source of elongate stock and a feed for forming a groove into the hardenable material and for supplying the elongate stock to the groove.

Turning now to the drawings, in which like reference characters indicate corresponding elements throughout the several views, FIG. 1 illustrates an isometric view of curb forming apparatus 20 constructed in accordance with the invention. Apparatus 20 comprises a device 21 for pushing hardenable material 22 through a channel 23 defined by a mold 24 to form a curb 30 upon a surface, a source 25 of elongate stock 26 and a feed 27 for forming a groove 28 into curb 30 and for supplying elongate stock 26 to groove 28. Device 21 may comprise one of a variety of known devices for extruding hardenable material including concrete, asphalt, plastic, etc., in curb form. As a matter of example, device 21 preferably comprises the apparatus disclosed in U.S. Pat. No. 4,310,293 of Jan. 12, 1982 for APPARATUS FOR MOULDING CONCRETE to Richard C. Eggleton, which is incorporated by reference herein. The structure and function of device 21 are clearly set forth in U.S. Pat. No. 4,310,293, and will not be discussed in great detail except to the extent necessary to provide a complete disclosure.

Figure 2:
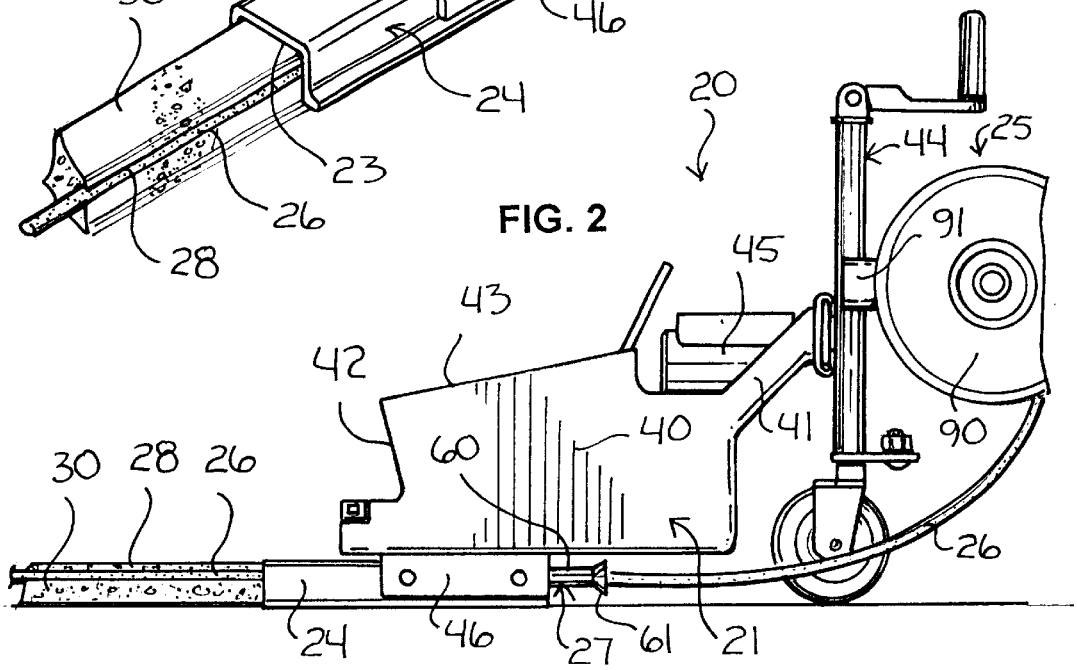
FIG. 2 is a side view of the curb forming apparatus of FIG. 1.

Regarding FIGS. 1 and 2, device 21 is comprised of a framework 40 having an upstream end 41 and a downstream end 42. Framework 40 defines a hopper 43 for receiving and containing hardenable material and feeding it to mold 24 which faces the surface that will support an extruded curb. In this example, hopper 43 is positioned toward downstream end 42. Framework 40 also supports a wheeled steering assembly 44 at its upstream end 41, a ram plate (not shown) mounted upstream of mold 24 and a motor 45 for driving the ram plate in a reciprocally linear direction for compacting and pushing the hardenable material through the mold 24. The compacting and pushing of hardenable material through mold 24 drives curb forming apparatus 20 in a direction leading with upstream end 41, leaving the extruded or molded curb 30 trailing behind downstream end 42. In this embodiment, mold 24 is carried by a fixture 46 mounted to framework 40 adjacent downstream end 42. However, framework 40 may support mold 24 directly if desired.

Figures 3, 4, 5, 6, 7, 8, 9:
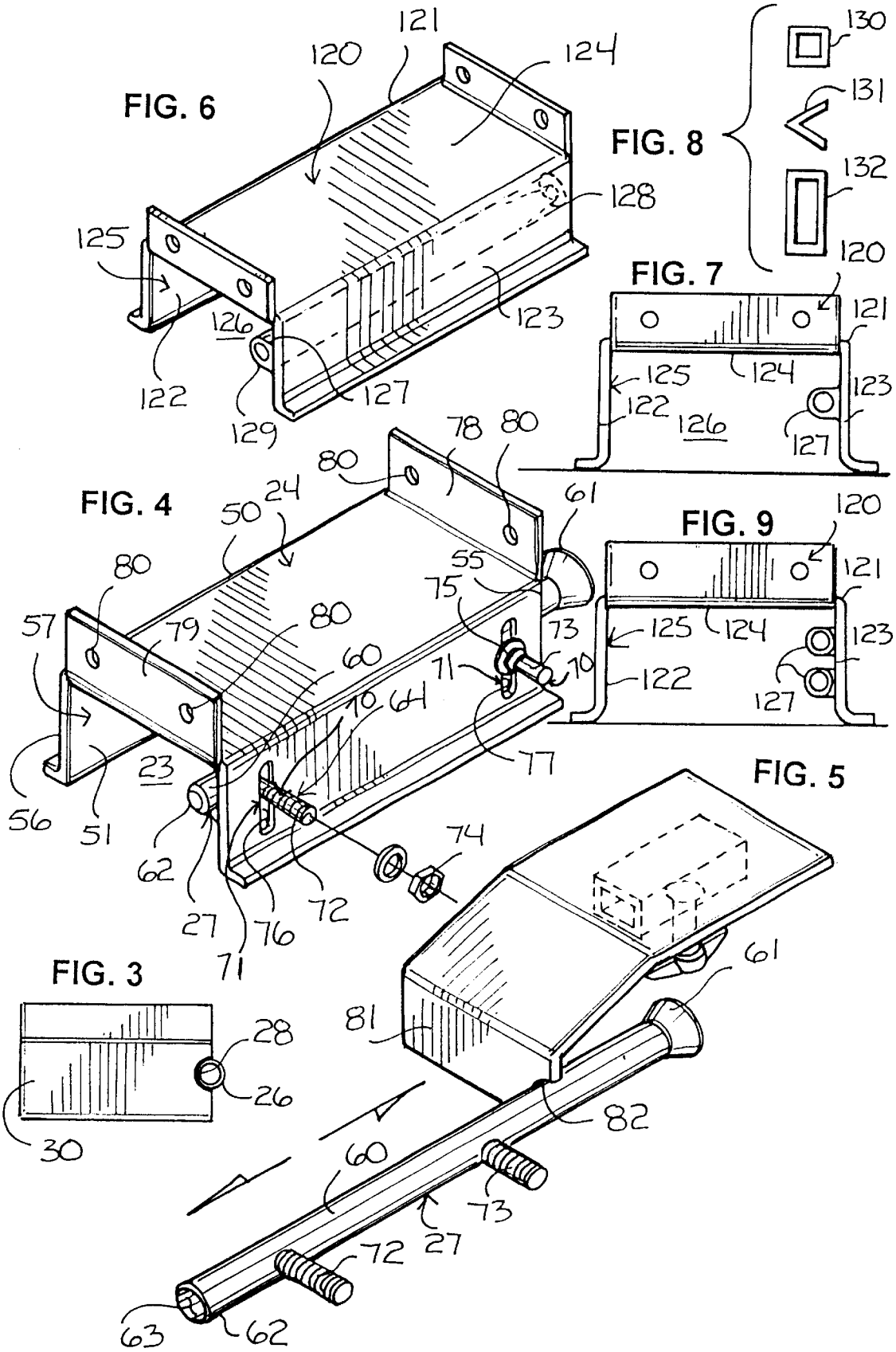
FIG. 3 is a vertical sectional view of a curb formed with the curb forming apparatus of FIG. 1.
FIG. 4 is an isometric view of an embodiment of a mold for receiving hardenable material therethrough from the device of FIG. 1 and the feed shown as it would appear carried by the mold.
FIG. 5 is an isometric view of the feed of FIG. 4.
FIG. 6 is an isometric view of another embodiment of a mold for receiving hardenable material therethrough from the device of FIG. 1, the mold supporting a protuberance for forming a groove into the hardenable material.
FIG. 7 is a side view of the mold of FIG. 6.
FIG. 8 are cross sectional views of embodiments of protuberances that may be employed with the mold of FIG. 6.
FIG. 9 is a side view of yet another embodiment of a mold for receiving hardenable material therethrough from the device of FIG. 1, the mold supporting a pair of protuberances each for forming a groove into the hardenable material.

Turning to FIG. 4, mold 24 is preferably constructed of steel, aluminum or other selected metal and comprises a generally U-shaped body 50 having sidewalls 51 and 52 that depend from an endwall 53 in spaced-apart and substantially parallel relation. Sidewalls 51 and 52 and endwall 53 cooperate to define an inner surface 57 that bounds or defines channel 23 which extends through body 50 from one end 55 to another end 56. Channel 23 is open and normally faces a support surface during extrusion operations. Those of ordinary skill will appreciate that by varying the manufacture of body 50, channel 23 may be provided in a variety of shapes and forms as desired.

In this embodiment, body 50 supports feed 27. Consistent with the ensuing discussion, feed 27 may be mounted to framework 40 if desired. During extrusion operations, feed 27 forms groove 28 (FIGS. 1 and 2) into curb 30 and supplies elongate stock 26 to groove 28, further details of which will be discussed presently. With momentary reference to FIG. 5, feed 27 is comprised of a receptacle or sleeve 60. Preferably constructed of metal, plastic or other substantially rigid material, receptacle 60 is tubular and includes an open upstream end 61 and an open downstream end 62 that both communicate with a passage 63 defined by receptacle 60. Turning back to FIG. 4, receptacle 60 is mounted to body 50 so as to reside totally or, perhaps, partially in channel 23, with its downstream end 62 positioned adjacent end 55 and its upstream end 61 positioned adjacent end 56. Receptacle 60 is mounted to, or otherwise carried by, sidewall 52 and extends into and, in this embodiment, through channel 23 against that portion of inner surface 57 defined by sidewall 52. Receptacle 60 is further mounted to sidewall 52 for movement between a first or raised position toward endwall 53 and a second different or lowered position away from endwall 53. An engagement assembly 64 provides this mounting and adjustment. Although the present embodiment shows receptacle 60 mounted to sidewall 52, it can be mounted at any location against inner surface 57 along endwall 53 or sidewall 51. The adjustable mounting of receptacle 60 with sidewall 51 would, of course, provide adjustment of receptacle 60 between raised and lowered positions. The adjustable mounting of receptacle 60 to endwall 53, however, would provide adjustment of receptacle from side to side between a position toward sidewall 51 and another position toward sidewall 52.

Engagement assembly 64 includes engagement apparatus 70 supported by receptacle 60 and detachably engagable complemental engagement apparatus 71 supported by sidewall 52. In this embodiment, engagement apparatus 70 comprises threaded bolts 72 and 73 carried by and extending from receptacle 60 in spaced-apart and substantially parallel relation, and threaded nuts 74 and 75 each threadably engagable with one of the threaded bolts 72 and 73. Complemental engagement apparatus 71 comprises elongate slots 76 and 77 positioned in spaced-apart and substantially parallel relation. Elongate slot 76 resides adjacent end 56 of body 50, and elongate slot 77 resides adjacent end 55 of body 50. To mount receptacle 60, threaded bolts 72 and 73 may each be passed through one of elongate slots 76 and 77, respectively, and receptacle 60 secured by threadably mounting threaded nuts 54 and 55 each with one of threaded bolts 72 and 73 and tightening them against sidewall 52. Because slots 76 and 77 are elongate, receptacle 60 may be positioned and secured at its raised or lowered positions and at any position therebetween. Those of ordinary skill will understand that a variety of engagement mechanisms may be employed for providing the disclosed adjustable mounting of receptacle 60 including varying forms of adjustable clamp mechanisms, snap fastening mechanisms, etc.

Turning back to FIGS. 1 and 2, mold 24 is preferably mounted to fixture 46 with conventional nuts and bolts so that it may be easily removed and replaced if necessary. Flanges 78 and 79 (FIG. 4) extending upwardly from ends 55 and 56, respectively, have through holes 80 that accommodate bolts for engagement to fixture 46. However, mold 24 can be more permanently affixed to fixture 46 with rivets or welding. When properly mounted, end 55 of mold 24 faces upstream end 41 and end 56 of mold 24 faces downstream end 42. End 55 receives hardenable material from hopper 43 and ram plate compacts and pushes the hardenable material through mold 24 from end 55. In FIG. 5, ram plate 81 resides adjacent receptacle 60 and runs reciprocally along a length of it between its upstream and downstream ends 61, 62 respectively. A recess 82 formed into ram plate 81 accommodates the body of receptacle 60 intermediate its upstream and downstream ends 61 and 62. Open upstream end 61 of receptacle 60 extends somewhat outboard of end 55 in a direction toward upstream end 41 of framework 40. As hardenable material is compacted and pushed through mold 24 for extruding a curb, receptacle 60 forms the groove 28 into the hardenable material. The ability to adjust feed 27 at and between its raised and lowered positions gives a user the flexibility to position groove 28 at one or more desired locations.

After extrusion, the hardenable material begins to harden or cure. Prior to curing, the curb is prone to damage or deformation. To inhibit groove 28 from being damaged prior to curing or from collapsing under the weight of the hardenable material after curb 30 formation, receptacle 60 operates to receive and conduct elongate stock 26 into groove 28 during the extrusion operation. Regarding FIG. 1, elongate stock 26 is constructed preferably of a flexible and resilient foam-like material such as Styrofoam or foam-like polyurethane. In the embodiment shown in FIGS. 1 and 2, the source 25 of elongate stock 26 is provided in the form of a roll carried by a reel or spool 90 mounted, in this specific embodiment, for rotation to a framework 91 fixed to steering assembly 44 upstream of feed 27. Alternatively, spool 90 may be mounted directly to steering assembly 44 or directly to framework 40 if desired.

Figures 12, 13, 14:
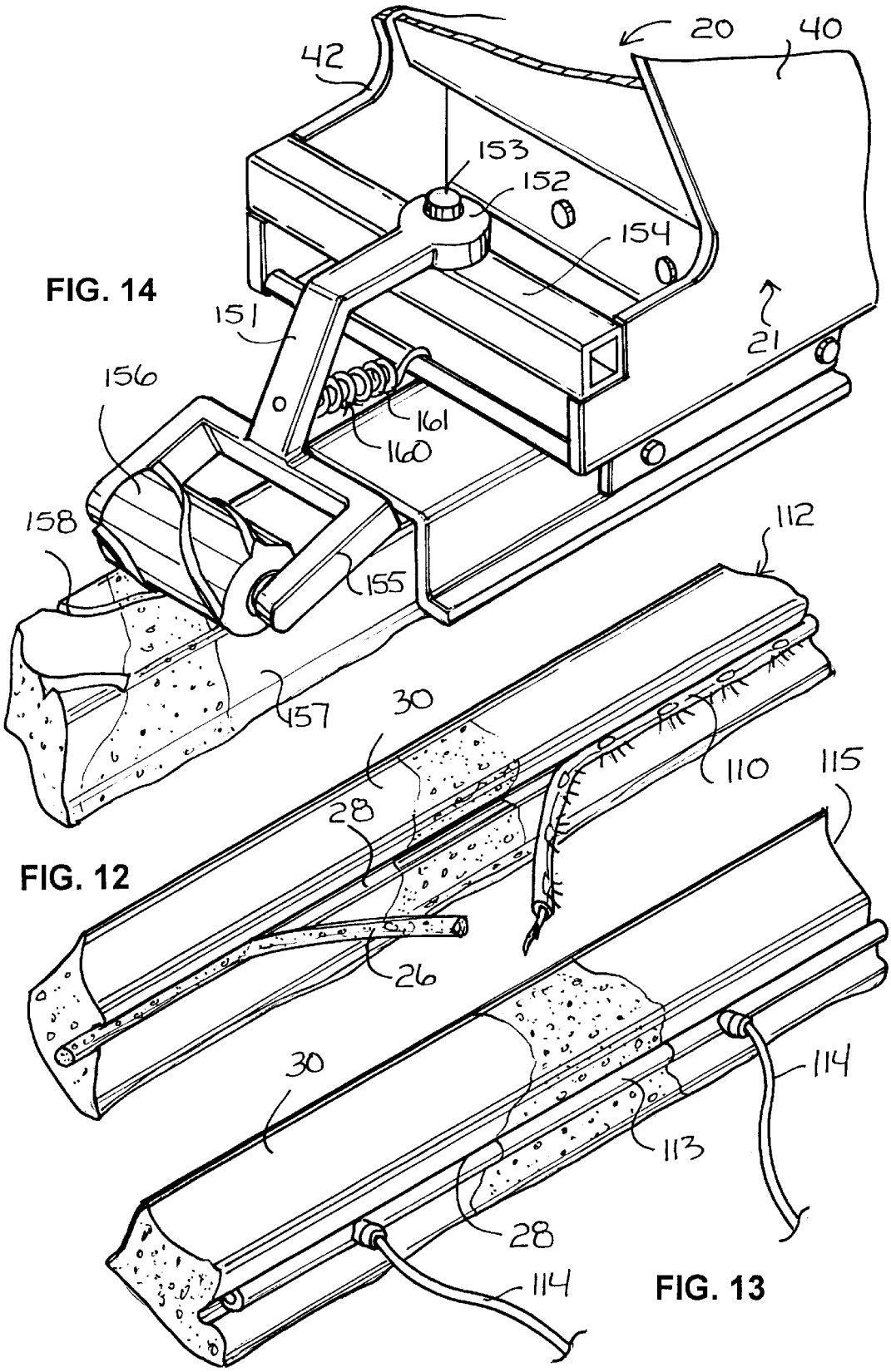
FIG. 12 is a fragmented isometric view of the elongate stock of FIG. 1 shown being removed from a groove formed into a curb and illumination apparatus shown being installed into the groove.
FIG. 13 is a fragmented isometric view of a curb having a groove supporting water distribution apparatus.
FIG. 14 is a fragmented perspective view of the device of FIG. 1 shown having stamp apparatus mounted to form an impression into an extruded curb.

Prior to extruding a curb, a free end of elongate stock 26 may be inserted into and through receptacle 60 from its upstream end 61. Upstream end 61 is somewhat enlarged for facilitating easy insertion, and receptacle 60 is sized for easily accommodating the elongate stock 26. After positioning the free end of the elongate stock 26 somewhat outboard or downstream of receptacle's 60 downstream end 62, extruding operations may commence. As the hardenable material 22 is forced through mold 24, it will pass by feed 27 which will, of course, form the groove 28 into the extruded curb 30. As the extruded curb 30 passes by receptacle's 60 downstream end 62, the elongate stock 26 engages and is recevied into groove 28. This engagement of elongate stock 26 against and into groove 28 draws elongate stock 26 from its source 25 along with the extruded curb 30. After a desired length of curb has been extruded, the elongate stock 26 may be severed, such as with a knife or scissors, at or adjacent receptacle's 60 upstream end 61 leaving curb 30 as it would appear in FIGS. 1 and 2 and in vertical cross section in FIG. 3. After waiting for a period of time sufficient to allow the concrete or hardenable material to at least partially cure or harden, elongate stock 26 may be grasped and pulled away and removed leaving the exposed groove 28 as shown in FIG. 12. Preferably, the elongate stock 26 should be removed only after the hardenable material or concrete has at least partially hardened or cured to inhibit the hardenable material from being damaged or compromised during removal. Elongate stock 26 maintains the shape of groove 28 and functions to support groove 28 from collapsing either from exposure to an external force or under the weight of the hardenable material.

In the present embodiment, feed 27 extends longitudinally in channel 23 along substantially the entire length of mold 24. It may, as previously mentioned, extend only partially into and through channel 23 if desired. To this end, not only can feed 27 be mounted with only its downstream end 62 extending into channel 23, but the invention contemplates that feed 27 may be mounted with its downstream end 62 extending into channel 23 through the mold 24 body 50. During extrusion operations in this regard, downstream end 62 forms the groove into the hardenable material and delivers the elongate stock 26 to the groove. Furthermore, although curb forming apparatus 20 has been disclosed as having only one feed 27 and one corresponding source of elongate stock 26, more than one feed and more than one source of elongate stock may be employed for forming a curb having a plurality of grooves.

§B. Curb Architectures

After the elongate stock 26 has been removed, groove 28 is available for accommodating an illumination apparatus 110 or a water distribution apparatus 111 (FIG. 13) for forming a useful curb architectures. Should two grooves be formed into a curb, each could certainly accommodate one of the illumination and water distribution apparatus 110 and 111. In the embodiment shown in FIG. 12, illumination apparatus 110 comprises a conventional device manufactured by RED LEAF INCORPORATED under the DURALIGHT TM trademark. Illumination apparatus 110 is elongate, tubular and flexible, and constructed of a diameter that approximates the diameter of elongate stock 26 so that after elongate stock 26 is removed from groove 28, illumination apparatus 110 may be forced or otherwise inserted into groove 28 in place of the elongate stock 26 as generally shown in FIG. 12. A layer of silicone or other conventional adhesive may be used for providing a rugged adhesion between groove 28 and illumination apparatus 110 if desired. So mounted or otherwise embedded in groove 28, illumination apparatus 110 may be energized with electrical energy for illumination, thus providing the integration of an extruded curb with lighting to form a useful curb architecture or assembly 112. This curb architecture 112 proves very useful in landscaping for providing illumination to sidewalks and pathways, flowers, gardens, etc. Because illumination apparatus 110 is elongate and flexible like elongate stock 26, it may be fed and installed into groove 28 through receptacle 60 during extrusion operations in lieu of elongate stock 26. Illumination apparatus 110 may therefore be carried by a spool mounted either directly or indirectly to framework 40 or steering assembly 44 much like spool 90.

In the embodiment shown in FIG. 13, water distribution apparatus 111 is comprised of a conduit 113 having one or more outlets 114. Conduit 113 is elongate, tubular, preferably flexible and constructed of a diameter that approximates the diameter of elongate stock 26 so that after elongate stock 26 is removed from groove 28, conduit 113 may be forced or otherwise inserted into groove 28 in place of the elongate stock 26 as shown. A layer of silicone or other conventional adhesive may be used for providing a rugged adhesion between groove 28 and conduit 113 if desired. So mounted or otherwise embedded in groove 28, conduit 113 may be coupled with a water source. The outlets 114 receive water from conduit 113 and disperse it to plants, thus providing the integration of an extruded curb with a watering system to form a useful curb architecture or assembly 115. This curb architecture 115 proves very useful in landscaping not only for a water distribution assembly, but also for concealing, protecting and supporting a watering system.

§C. Extrusion Molds

Groove 28 formation can be accomplished with feed 27 without elongate stock 26 if desired. In this regard, feed 27 would serve as a protuberance extending into channel 23 for forming a groove during extrusion operations. Rather than mounting a protuberance for adjustment like feed 27, a protuberance may be removably mounted at a fixed position or immovably fixed if desired.

In this regard, FIGS. 6 and 7 show a mold 120 that, like mold 24, comprises a generally U-shaped body 121 including sidewalls 122 and 123 that depend from an endwall 124 in spaced-apart and substantially parallel relation. Sidewalls 122 and 123 and endwall 124 cooperate to define an inner surface 125 that bounds or defines a channel 126 extending therethrough through which hardenable material may be forced. Further included is a protuberance 127 immovably fixed to inner surface 125 defined by sidewall 153. Protuberance 127 may, of course, be mounted to inner surface 125 at other locations. In this embodiment, protuberance 127 is elongate, extends longitudinally along substantially the entire length of body 121 in channel 126 and includes an upstream end 128 and a downstream end 129. Upstream end 128 normally faces the flow of oncoming hardenable material and, in this embodiment, is shown somewhat tapered. Protuberance 127 is either welded to, or integrally formed with, body 121. Protuberance 127 can be constructed and arranged to extend along only a partial length of body 121 if desired.

Although mold 120 is shown having only one protuberance 127, it may include two (FIG. 9) or more such protuberances 127 for forming a curb having a plurality of grooves. Additionally, protuberance 127 is shown having a circular cross section for forming an arcuate or curved groove into hardenable material. FIG. 8 shows protuberances having square 130, triangular 131 and rectangular 132 cross sections. Other geometric shapes may be employed if desired.

§D. Hand Trowel

Figure 10:
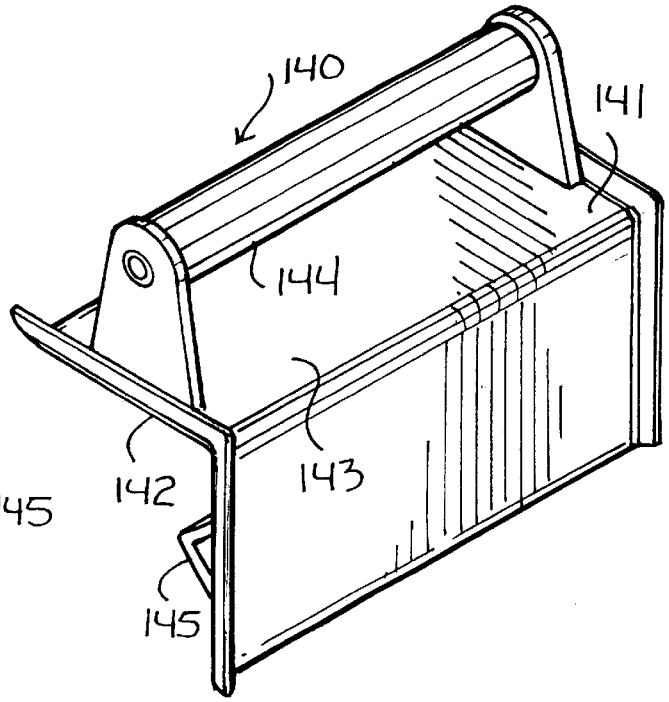
FIG. 10 is an isometric view of a hand trowel for forming a groove into hardenable material.
Figure 11:
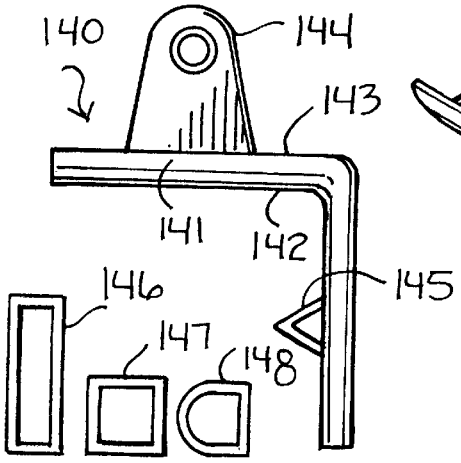
FIG. 11 is a side view of the hand trowel of FIG. 10.

Providing a curb with a groove is important in the construction of each of the curb architectures 112 and 115 discussed in §B, infra. In this regard, rather than form a groove during curb extrusion, a groove may be formed into a curb after extrusion if desired. To that end, FIGS. 10 and 11 show a hand trowel 140 comprising an angled body 141 having an inner surface 142, an outer surface 143, a handle 144 carried by the angled body 141 adjacent the outer surface 143 and a protuberance 144 mounted, either removably or immovably, to inner surface 142. Before a newly extruded curb hardens or cures, a user may grasp handle 144, such as with his or her hand, support inner surface 142 of hand trowel 140 against the curb and, by moving hand trowel 140 along and against the curb, present protuberance 145 into the curb to form a groove. Although protuberances 145 is shown having a triangular shape, FIG. 11 shows other protuberant shapes that may be used including rectangular 146, square 147, arcuate 148, etc.

§E. Stamp Apparatus

To enhance aesthetic appearance, it is often desirable to form decorative impressions into extruded curbing. FIG. 14 illustrates a stamp apparatus 150 for carrying out this task. In this embodiment, stamp apparatus 150 comprises an elongate support 151 having a proximal end 152 mounted for pivotal movement at a pivot point 153 to a transom 154 carried by framework 40 proximate its downstream end 42. Consistent with this discussion, elongate support 151 can be mounted with framework 40 at other locations. Elongate support 151 extends outwardly from transom 154 at terminates with a bifurcated distal end 155 that supports a textured roller 156 for rotation. As a curb 157 is extruded with curb forming apparatus 20, elongate support 151 supports and directs roller 156 against curb 157. As curb forming apparatus 20 moves along, roller 156 rolls across curb 157 leaving a decorative impression 158. A biasing element 160 connects framework 40 with elongate support 151 between its proximal and bifurcated distal ends 152 and 155 and provides a sufficient amount of tension to bias elongate support 151 downwardly for forcing roller 156 to run smoothly across the curb 157 to leave an evenly formed decorative impression 158. Biasing element 160 may comprise a compression spring 161 as shown, an elastomeric element or other similar biasing mechanism.

The present invention has been described above with reference to preferred embodiments. Those skilled in the art will recognize that changes and modifications may be made in the described embodiments without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Curb forming apparatus comprising:

a device for receiving and forcing hardenable material through a channel defined by a mold of the device to form a curb having an outer surface;

a source of elongate stock;

a protuberance carried by the device for forming a groove into the outer surface of the curb; and a passage defined by the protuberance for receiving and feeding the elongate stock into the groove, wherein the elongate stock is removable from the groove.

2. Curb forming apparatus of claim 1, wherein the source of elongate stock is carried by the device.

3. Curb forming apparatus of claim 1, wherein the protuberance is carried by the mold of the device.

4. Curb forming apparatus of claim 1, wherein the protuberance defines an upstream end of the passage for receiving the elongate stock and a downstream end of the passage for directing the elongate stock into the groove.

5. Curb forming apparatus of claim 4, wherein the downstream end extends into the channel.

6. Curb forming apparatus of claim 1, wherein the protuberance is adjustable between a first position and a second different position.

7. Curb forming apparatus of claim 3, wherein the protuberance is carried by the mold for movement between a first position and a second different position.

8. In a device for pushing hardenable material through a channel defined by a mold of the device for forming a curb having an outer surface, an assembly carried by the device comprising:

a source of elongate stock;

a protuberance for forming a groove into the outer surface of the curb; and a passage defined by the protuberance for receiving and feeding the elongate stock into the groove, wherein the elongate stock is removable from the groove.

9. The assembly of claim 8, wherein the source of elongate stock is carried by the device.

10. The assembly of claim 8, wherein the protuberance is carried by the mold.

11. The assembly of claim 8, wherein the protuberance defines an upstream end of the passage for receiving the elongate stock and a downstream end of the passage for directing the elongate stock into the groove.

12. The assembly of claim 11, wherein the downstream end extends into the channel.

13. The assembly of claim 8, wherein the protuberance is adjustable between a first position and a second different position.

14. The assembly of claim 10, wherein the protuberance is carried by the mold for movement between a first position and a second different position.

15. Curb forming apparatus comprising:

a device for pushing hardenable material through a channel defined by a mold of the device for forming a curb having an outer surface;

a source of elongate stock carried by a reel mounted to the device for rotation;

a protuberance for forming a groove into the outer surface of the curb; and a passage defined by the protuberance for receiving and feeding the elongate stock into the groove, wherein the elongate stock is removable from the groove.

16. Curb forming apparatus of claim 15, wherein the protuberance is carried by the mold.

17. Curb forming apparatus of claim 15, wherein the protuberance defines an upstream end of the passage for receiving the elongate stock and a downstream end of the passage for directing the elongate stock into the groove.

18. Curb forming apparatus of claim 17, wherein the downstream end extends into the channel.

19. Curb forming apparatus of claim 15, wherein the protuberance is adjustable between a first position and a second different position.

20. Curb forming apparatus of claim 16, wherein the protuberance is carried by the mold for movement between a first position and a second different position.

21. A curb formed with the apparatus of claim 15.

22. A curb formation method comprising the steps of:

providing a protuberance extending into a channel defined by a mold;

pushing hardenable material through the channel to form a curb having an outer surface and a groove formed into the outer surface by the protuberance;

filling the groove with elongate stock;

waiting for the hardenable material to at least partially cure; and removing the elongate stock from the groove.

23. The curb formation method of claim 22, wherein the step of filling the groove with elongate stock further includes the steps of:

providing the protuberance with a passage having an upstream end and a downstream end directed into the groove; and passing the elongate stock through the passage from the upstream end to the downstream end.

* * * * *